United States Patent [19]

Keyzer

[11] Patent Number: 4,645,002

[45] Date of Patent: Feb. 24, 1987

[54] RADIATOR

[75] Inventor: Willem G. Keyzer, Uden, Netherlands

[73] Assignee: NRF Holding B.V., Netherlands

[21] Appl. No.: 670,263

[22] Filed: Nov. 13, 1984

[30] Foreign Application Priority Data

Oct. 17, 1983 [NL] Netherlands ..... 8303966

[51] Int. Cl.[4] ..... F28F 9/02

[52] U.S. Cl. ..... 165/175; 165/173

[58] Field of Search ..... 165/173, 149, 175; 285/364

[56] References Cited

U.S. PATENT DOCUMENTS

| | | | |
|---|---|---|---|
| 3,894,580 | 7/1975 | Chartet | 165/149 X |
| 4,461,348 | 7/1984 | Toge et al. | 165/173 |

FOREIGN PATENT DOCUMENTS

| | | | |
|---|---|---|---|
| 0028951 | 5/1981 | European Pat. Off. | 165/149 |
| 2703528 | 8/1978 | Fed. Rep. of Germany | 165/76 |
| 3222300 | 12/1983 | Fed. Rep. of Germany | 165/148 |
| 497144 | 8/1954 | Italy | 165/149 |
| 2108648 | 5/1983 | United Kingdom | 165/149 |

*Primary Examiner*—Albert W. Davis, Jr.
*Assistant Examiner*—Richard R. Cole
*Attorney, Agent, or Firm*—Allen D. Gutchess, Jr.

[57] ABSTRACT

A radiator comprising a pipe block having channels for passing a fluid to be cooled with the aid of air flowing around the channels and with fluid collecting casings arranged near the ends of the pipe block, in which the pipe block or the water casing has an at least substantially U-section continuous groove and the water casing or the pipe block respectively is provided with a continuous fixing rim fitting in the U-section groove with the interposition of a resilient gasket, while a limb bounding the U-section groove has holes for receiving guard members, with the aid of which the pipe block and the water casing can be fastened to one another, a guard member being formed by a strip-shaped part and fingers adjoining the strip-shaped part and being transverse of the strip-shaped part, said fingers being passed through the holes in the limb bounding the U-section groove and engaging the fixing rim.

4 Claims, 5 Drawing Figures

RADIATOR

The invention relates to a radiator comprising a pipe block having channels for passing a fluid to be cooled with the aid of air flowing around the channels and fluid collecting casings near the ends of the pipe block, said pipe block or the water casing having an at least substantially U-section, continuous groove and the water casing or the pipe block respectively being provided with a continuous fixing rim fitting in the U-section groove with the interposition of a resilient gasket, whilst a limb bounding the U-section groove has holes for receiving guard members, with the aid of which the pipe block and the water casing can be connected with one another.

Such radiators or air-cooled heat exchangers are used, for example, for cooling cooling water or lubricating oil of combustion engines for heating the interior of vehicles and the like.

With such radiators it is necessary to remove the water casings from the pipe block and to remount them several times for inspection, repair or replacement of the component parts during the life of the radiator.

German patent application No. 2,035,947 laid open for public inspection discloses a construction in which the outer boundary rim of the U-section groove covers a comparatively large height along the fixing rim forming part of the water casing and extending as far as above said outer rim of the U-section groove. The fixing members are U-shaped brackets provided with tags inserted into holes in the limb and engaging the inner side of the limb. The part of the bracket projecting above the limb is inwardly bent over and the free end of the bent-over part enters a groove formed in the water casing. A disadvantage of this known construction is that the various parts such as the outer rim of the U-section groove, the fixing rim and the clamping brackets all have to be relatively large, which adversely affects the weight of the radiator. Moreover, the use of a bent-over end of the fastening bracket cannot ensure a rigid connection, since the junction will be slightly resilient, which may give rise to leakage in the course of time. A further disadvantage of this known construction is that the free end of the bent-over upper part of the fastening bracket is located by a relatively sharp edge in a groove in the water casing, which may give rise to breakdown of the material, in particular in the case of casings made from synthetic resin.

German patent application No. 2,035,947 laid open for public inspection describes a construction in which the water casing is provided on the outer side with projecting ears which have to snap into holes in the outer limb of the U-section groove. The boundary edge of the opening in the limb of the groove engages by a relatively sharp edge the ear passed through the opening so that after some time wear of the ear and/or breakdown of the ear will occur, which will give rise to leakage. Apart therefrom, the water casing can practically not be dismounted.

The invention has for its object to provide a radiator of the kind set forth by which the disadvantages inherent in the known constructions can be avoided.

According to the invention this can be achieved in that a guard member is formed by a strip-shaped part and fingers adjoining said strip-shaped part and extending transversely of said strip-shaped part, said fingers being passed through the holes in the limb bounding the U-section groove and engaging the fixing rim.

With the construction embodying the invention by using simple fixing members formed by strip-shaped parts provided with projecting fingers, mounting and dismounting of the water casing on and from the pipe block respectively can be readily carried out in a simple manner, whilst the construction can be compact with a light weight.

The invention will be described more fully hereinafter with reference to an embodiment of the construction in accordance with the invention shown in the accompanying drawings.

Figure 1:
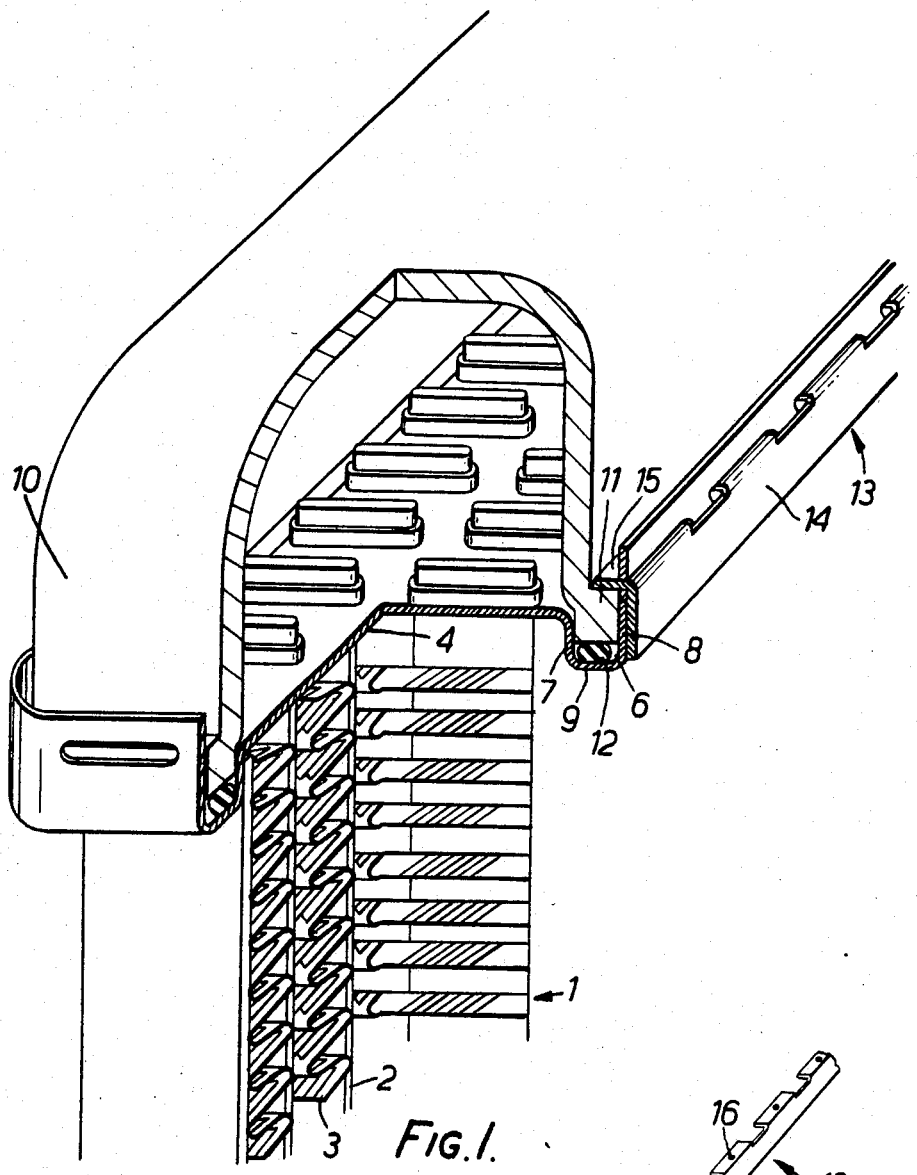
FIG. 1 is partly a perspective, partly an elevational view and partly a sectional view of part of a pipe block and part of a collecting casing of a radiator embodying the invention.

FIG. 1 shows part of a radiator comprising a pipe block 1, which is formed in a conventional manner by a plurality of relatively parallel channels or pipes 2 interconnected by zig-zag-shaped strips 3 bounding passages for air streaming transversely of the direction of length of the channels through the pipe block during operation. The ends of the pipes 2 are passed through and fastened to holes 5 in end plates 4.

In the embodiment shown the end place is surrounded by a U-section groove 6, which is bounded by two at least substantially parallel limbs or flanges 7 and 8 being integral with the end plate and by a web 9 between the limbs. From the Figures it will be apparent that the outer limb 8 is higher than the inner limb 7 so that the top end of the outer limb projects above the end plate 4. The outer limb 8 has at equal intervals elongate holes 8' extending in the direction of length of the outer limb.

On the end plate 4 is arranged a hood or cover 10, which together with the end plate bounds a collecting casing in which the channels 2 of the pipe block are opening out.

The hood 10 has a thickened fixing rim 11, which projects at least partly out of the outer side of the hood 10 and which is bounded on the bottom side as well as on the top side by boundary faces extending at least substantially parallel to the end plate 4 and the web 9 interconnecting the limbs 7 and 8 of the U-section groove. A resilient gasket 12 is arranged between the underside of the rim 11 and the bottom of the U-section groove formed by the web 9.

Figure 3:
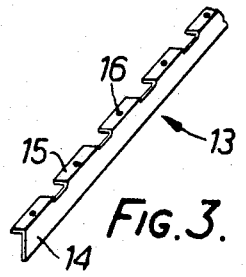
FIG. 3 is a perspective view of a fixing profile.
Figure 2:
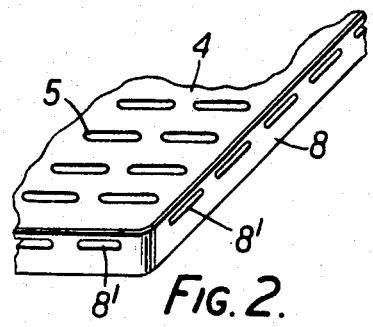
FIG. 2 is a perspective view of part of an end plate of a pipe block.

The hood 10 is fixed to the pipe block by means of fixing profiles or elongate guard members 13 (FIG. 3). A fixing profile 13 comprises a flat, strip-shaped part 14, an edge of which is provided with fingers 15 extending at right angles to said strip-shaped part and being integral with said strip-shaped part, the distance between said fingers being such that they fit in the manner shown in the Figures in the relatively spaced elongate holes 8' in the boundary limb 8 of the U-section groove extending around the end of the pipe block.

Each finger 15 is provided with a depressed part forming an extension 16 projecting above the finger.

Figure 4:
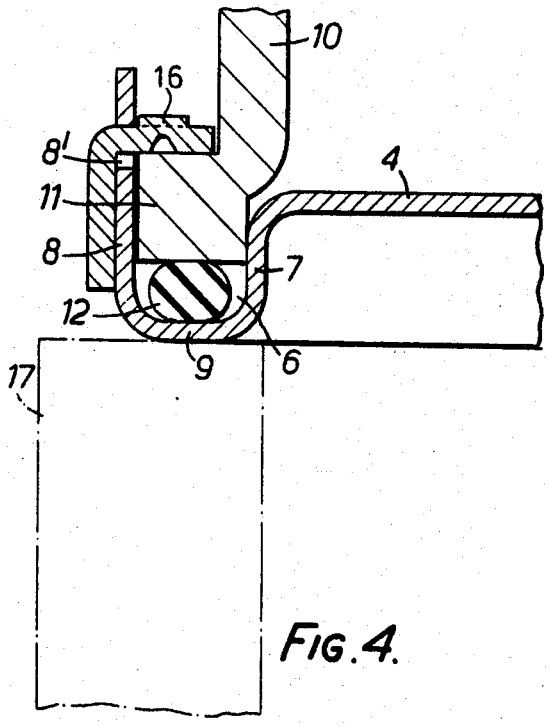
FIG. 4 is an enlarged sectional view of the U-section groove and the fixing rim located therein.
Figure 5:
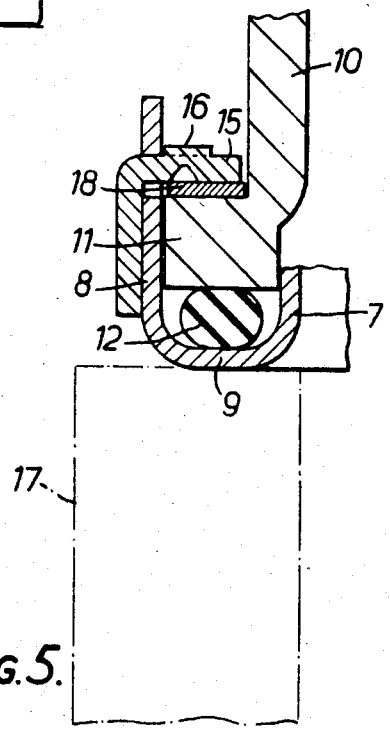
FIG. 5 is a sectional view like FIG. 4, in which a correction strip is provided to compensate for any wear phenomena.

The thickness of a finger 15 with an extension 16 is equal to or smaller than the width of a slot 8' in order to allow passage of the fingers through the slots. From FIGS. 1 and 4 it is in particular apparent that in the mounted state the fingers 15 passed through the slots 8' are located above the part of the rim 11 projecting out of the hood 10. The design is such that in order to allow insertion of the fingers 15 into the slots 8' the rim 11 of the hood 10 has to be pressed down against the spring force of the gasket 12 to an extent such that the upper boundary wall of the rim 11 comes level with the lower boundary edges of the slots 8'. This may be ensured, for example, by disposing the edge of the end plate 4 on a support 17 as is schematically shown in FIG. 4, after which a force is exerted on the cover 10 in downward direction as viewed in FIG. 4. After the gasket 12 is thus compressed and the various fixing profiles 13 have been passed along the edges of the end plate 4 being at an angle to one another through the slots 8' concerned, the force exerted on the cover can be eliminated so that the cover 10 will be urged upwards, as viewed in FIG. 4, by the resilient gasket 12 into the position shown in FIG. 4. The design of the resilient gasket 12 is such that also in this position still sufficient pressure is exerted on the gasket 12 to ensure a seal in the area of the gasket. The projecting parts 16 of the fingers 15 are locked behind the limb 8 bounding the continuous, U-section groove so that the fingers 15 of the fixing profiles cannot be withdrawn from the slots.

It will be obvious that a removal of a hood 10 from a pipe block can be simply carried out by pressing the hood 10 downwards, as viewed in FIG. 4, against the spring force of the resilient gasket 12 into a position such that the fixing profiles 13, in particular the fingers 15 of these fixing profiles can be withdrawn from the slots. After the removal of the fixing profiles 13 the hood can be taken off in a simple manner. For this purpose no specific, complicated tools are required so that the removal of the hoods from the pipe block for maintenance, repair and the like can be carried out in a simple manner in small workshops and the like.

It will furthermore be obvious that within the spirit and scope of the invention complements and/or modifications of the embodiment described above and illustrated in the Figures are conceivable. For example, the end plate may be provided with a fixing rim and the hood with a U-section groove for accommodating such a fixing rim. Instead of using a fixing profile extending along the whole side of a pipe block, several, separate fixing parts may be used, whilst fingers in the form of, for example, pins engaging the rim may be employed. The fingers, pins or the like may, as an alternative, engage the fixing rim by inserting the fingers, pins or the like into recesses provided for this purpose in the fixing rim.

In order to compensate for clearance resulting from wear or the like a filling strip 18 may be arranged between the rim 11 and the fingers 15 as shown in FIG. 4.

The Figures used in the claims are only meant to explain more clearly the intention of the invention and are not supposed to be any restriction concerning the interpretation of the invention.

What is claimed is:

1. A radiator comprising a pipe block having channels for passing a fluid to be cooled with the aid of air flowing around the channels, fluid-collecting casings positioned near the ends of said pipe block, said pipe block having continuous grooves of substantially U-shaped cross section around peripheries thereof, said casings have continuous rims around peripheries thereof, said rims extending into said continuous grooves, each of said grooves having an outer flange with holes spaced therealong, a resilient gasket positioned between the bottom of each of said grooves and a face of the corresponding rim, a separate guard member for each of said grooves having a strip-shaped part with fingers extending transversely from an edge portion of said strip-shaped part and spaced therealong, said fingers extending through said holes and engaging a surface of the corresponding rim located on the side of said rim remote from the corresponding gasket, and which is substantially parallel to the face of the rim, said fingers urging the rim toward the bottom of the corresponding groove to maintain the corresponding gasket under compression.

2. A radiator according to claim 1 characterized by said fingers having extensions thereon facing away from the surface of the rim which they engage.

3. A radiator comprising a pipe block having channels for passing fluid to be cooled with the aid of air flowing around the channels, a fluid-collecting casing positioned near one end of said pipe block, said pipe block having a continuous groove of substantially U-shaped cross section around the periphery thereof, said casing having a continuous rim around the periphery thereof, said rim extending into said continuous groove, said groove having an outer flange with holes spaced therealong, a resilient gasket positioned between the bottom of said groove and a face of said rim, a separate guard member having a strip-shaped part with fingers extending transversely from an edge portion of said strip-shaped part and spaced therealong, said fingers extending through said holes and engaging a surface of said rim which is spaced from and substantially parallel to said face of said rim and urging said rim toward the bottom of said groove to maintain said gasket under compression.

4. A radiator according to claim 3 characterized by said fingers having extensions thereon facing away from the surface of the rim which they engage.

* * * * *